United States Patent [19]

Motsenbocker

[11] 4,420,097

[45] Dec. 13, 1983

[54] PORTABLE LIQUID DISPENSER WITH CARRYING CASE

[76] Inventor: Gregg A. Motsenbocker, 874 Felspar St., San Diego, Calif. 92109

[21] Appl. No.: 225,267

[22] Filed: Jan. 15, 1981

[51] Int. Cl.[3] ..... B65D 33/06; B65D 33/36; B65D 35/14

[52] U.S. Cl. ..... 222/131; 62/372; 62/457; 62/530; 222/146 C; 222/175; 222/511; 222/215

[58] Field of Search ..... 222/92, 105, 107, 530, 222/175, 146 C, 129, 173, 326, 146 R, 131, 511, 215; 62/372, 457, 530

[56] References Cited

U.S. PATENT DOCUMENTS

| | | | |
|---|---|---|---|
| 1,902,548 | 3/1933 | Fenwick, Jr. | 222/175 |
| 2,558,181 | 6/1951 | Kassel | 222/175 |
| 2,684,787 | 7/1954 | Charpiat | 222/175 |
| 3,093,273 | 6/1963 | Borah | 222/530 |
| 3,112,047 | 11/1963 | Weinreich et al. | 222/105 |
| 3,326,421 | 6/1967 | Peace | 222/530 |
| 4,196,817 | 4/1980 | Moser | 222/105 |

*Primary Examiner*—David A. Scherbel
*Attorney, Agent, or Firm*—Brown & Martin

[57] ABSTRACT

Plastic sheet material forms a thin generally pillow shaped liquid container. A dispenser incorporates an elongated tube with a valve and nozzle at the distal end. The carrying case is shaped like the container and protects and insulates the container.

17 Claims, 6 Drawing Figures

PORTABLE LIQUID DISPENSER WITH CARRYING CASE

BACKGROUND OF THE INVENTION

From time immemorial man has struggled with the problem of carrying liquids on his person to provide either the basic need for water during travel or to satisfy a desire for refreshment.

Various insulated ice chests are produced in great numbers in order to carry canned, bottled and other beverage containers to recreation areas. However, even the smallest of these containers are difficult to carry and cannot be carried hands-free.

Hikers carry bottles and canteens on their persons and in their packs, but these containers have a limited capacity and provide no insulation for their contents.

Various insulated jugs have been provided and some such jugs provide a controllable valve and spout for dispensing of the liquid contents, but these jugs are clumsy and cannot be carried hands-free. Further, such containers cannot maintain liquid contents at a substantial temperature differential from ambient for long periods of time without the addition of ice to maintain temperature. The addition of ice results in the dilution of the liquid, which is unacceptable for some beverages and particularly carbonated beverages.

Bota bags are not insulated and are not useful with heated or cooled liquids because they have no provision for ice and no insulation. These bags are bulky in their shape and as a result it is impractical to carry a large quantity of liquid in them or to conveniently stow them when the user is seated. Because the nozzle and filler are on the bag itself, the bags must be raised above the user's head and the liquid dispensed directly into the users mouth with the resultant risk of spillage.

Accordingly, it is desirable to have a container for liquids which is easily carried by a user and is so sized and shaped to be carried hands-free when travelling and which can be stored out of the way when the user is seated. Such a liquid container is particularly valuable where means are provided for dispensing the liquid at a location remote from the container and where liquids can be cooled by an internal supply of ice without dilution of the liquid contents.

SUMMARY OF THE INVENTION

An exemplary embodiment of the invention overcomes the disadvantages associated with prior art portable liquid containers and coolers, while at the same time providing heretofore unattainable advantages for the comfort and convenience of the user.

A container comprised of flexible sheet material in a generally pillow shaped configuration is provided. A fabric carrying case is similarly shaped. The relative thinness of the container and carrying case in the smallest dimension makes it possible to carry a substantial quantity of liquid with the container and case slung over the shoulder or carried in the manner of a back-pack. The carrying case protects and insulates the container.

Even when carried as a back-pack, it is possible to dispense liquids from the container by the use of the dispenser which incorporates an elongated tube connecting from the interior of the container to a remote valve and nozzle. The user can fill cups and glasses without removing the container from his shoulder or back by extending the valve and nozzle from the container and then filling the cup or glass at a point below the liquid level of the liquid in the container. Gravity flow and the progressive collapse of the flexible sheet material makes it possible for a relatively small elevational difference to dispense liquids at an acceptable rate.

The fabric carrying case may incorporate an inner insulative layer to retard temperature changes in the carried liquid. When cool liquids are carried, an internal sack with a freezable liquid may be utilized to economically and efficiently provide the necessary cooling. The entire container, when empty, may be folded to a relatively small dimension so that only the internal compartment containing a non-toxic freezable liquid remains uncompressed. The folded container may then be refrigerated to freeze the freezable liquid. Immediately prior to use the container is then filled with the beverage or other liquid.

During use and when the counter is full of liquid, a maximum shape and profile is maintained by internal webbing so that the device retains its desirable shape for carrying.

In an alternative embodiment, a second internal container is provided. The second internal container can be filled with a second beverage or may be filled with water and the water then frozen to provide cooling in a manner similar to that described for the internal freezable liquid.

When seated, such as at a sporting event, the container serves the additional purpose of providing a pad or seat cushion. Since the carrying pouch may be insulated, the user is not effected by the temperature of the liquid contents. At the same time, the liquid contents serve to form a very soft and compliant cushion with much better seating characteristics than can normally be obtained in a stadium cushion. As beverage is dispensed and the liquid contents become depleted, the cushioning characteristics can be maintained by the user expelling air from his lungs through the dispensing means and into the interior of the container so that the resulting internal air pressure will support the user.

The many improvements, advantages and benefits of the invention will become more apparent upon the reading of the following detailed description together with the drawings in which like reference numerals refer to like parts throughout and in which:

DETAILED DESCRIPTION OF THE DRAWINGS

Figure 1:
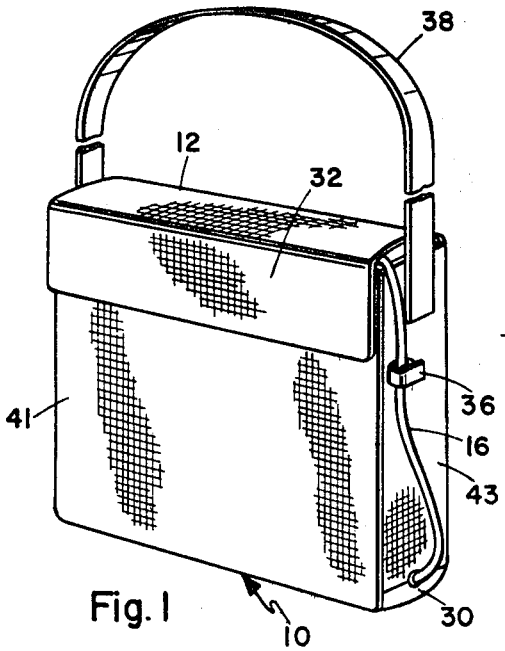
FIG. 1 is a perspective view of the complete portable liquid dispenser and carrying case.
Figure 2:
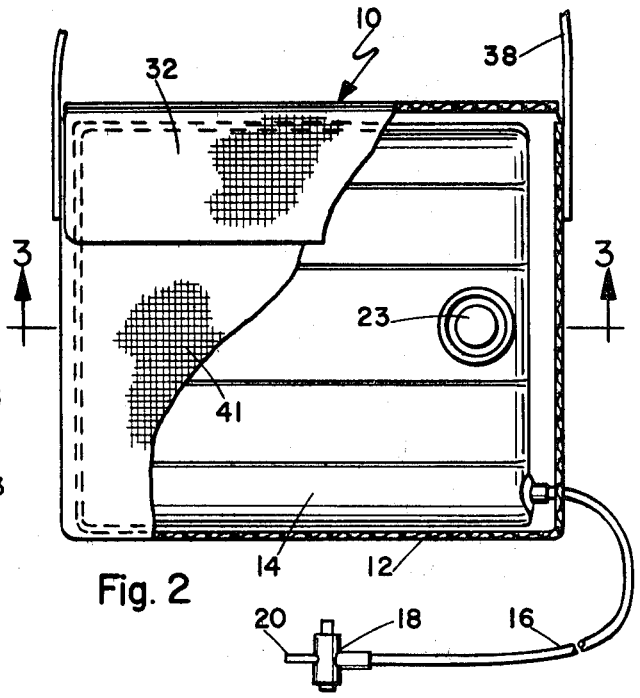
FIG. 2 is a side elevation view with a portion of the outer pouch cut away.
Figure 3:
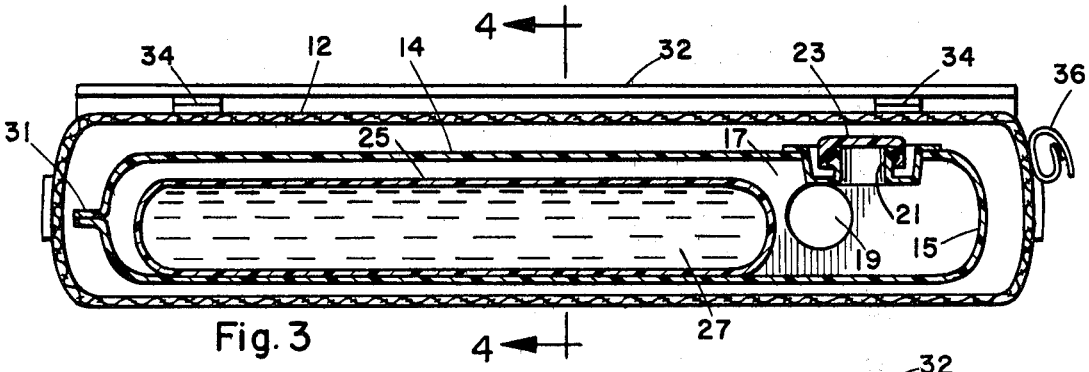
FIG. 3 is an enlarged sectional view taken on line 3—3 of FIG. 2.

Referring now to FIGS. 1–3, there is illustrated the dispenser 10 incorporating a carrying case 12 which houses the container 14. A means for dispensing the liquid from the container 14 is provided by the tube 16 which connects between the container 14 and a valve 18. When the valve 18 is opened, liquid is dispensed from the nozzle 20. The detailed construction of the container 14 is best seen in FIG. 3. Flexible plastic sheet material 15, such as poly-vinyl chloride, is formed into a pillow shaped container by bonding at joint 31 and 33 (see FIG. 4). The resulting container is generally rectangular in planar configuration and has a thickness dimension which is less than one-quarter the principal dimension of the container. A plurality of internal webs 17 are provided to maintain the shape of the container even when it is full of liquid, so that it may still be carried under the arm and also to prevent overstressing the plastic sheet material by an excessive quantity of liquid. The liquid may pass back and forth through the webs through a plurality of openings 19.

The means for admitting liquid incorporates a retractable filler neck 21, which after use may be pressed to within the container 14 so that the upper portion thereof is substantially flush with the outer surface of the container. A liquid-tight closure is provided by the threaded cap 23. An internal compartment 25 is formed within the container 14. Compartment 25 is a completely sealed compartment containing a freezable liquid 27. The freezable liquid may be water or any of the commercially available re-freezable liquids which provide a high degree of cooling per net volume. Because the liquid stored in the container is free to move within the openings 19, liquid can move back and forth across the surfaces of the internal compartment 25 and therefore a direct heat transfer relationship is established whereby the liquid in the internal compartment 25 cools the liquid in container 14.

Figure 6:
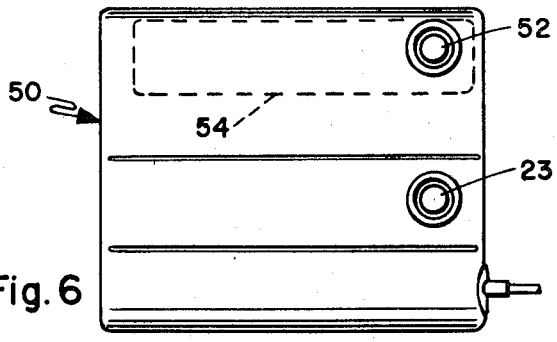
FIG. 6 is a top plan view of an alternative configuration of the invention utilizing a secondary inner sack to provide dual individually fillable compartments.

Referring now to FIG. 6, an alternative configuration for the container is illustrated. A container 50 incorporates the primary filler neck 21 and a secondary filler neck 52. Neck 52 is connected to an internal sack 54. Sack 54 is made up of the same flexible plastic material as comprises the container 50. Thus when a liquid is admitted through the filler neck 52, the secondary sack 54 expands to accommodate it. For example, sack 54 may be filled with water and the water frozen to provide cooling. When no liquid is admitted to the sack 54, it collapses under the pressure of liquid admitted through the filler neck 21 so that the overall capacity of the container 50 is not significantly affected.

Figure 5:
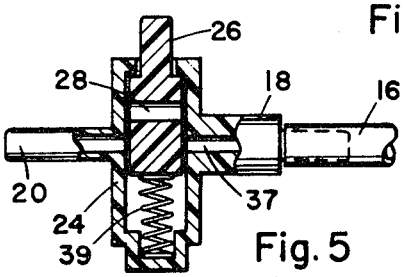
FIG. 5 is an enlarged view of the valve and nozzle assembly with portions cut away.

The valve 18 is illustrated in FIG. 5 and comprises a valve body 24 in which a valve operator 26 reciprocates. When the opening 28 in the operator is aligned with the opening 37 in the valve body, the liquid can pass from the tube 16 through the valve and out of the nozzle 20. A spring 39 returns the valve operator to the off position when pressure on the operator 26 is released.

Figure 4:
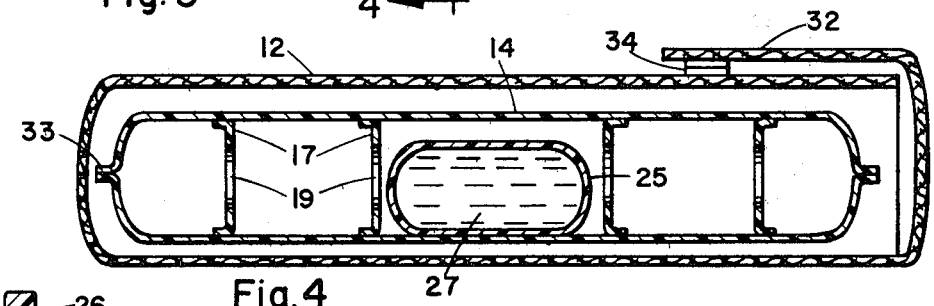
FIG. 4 is a sectional view taken on line 4—4 of FIG. 3.

Referring particularly to FIGS. 1 and 4, the carrying case 12 is illustrated. The carrying case 12 has a shape corresponding to that of the container 14. i.e., with large planar surfaces, such as the surface 41, and a relatively small thickness 43. So shaped, it is possible for a person to carry the carrying case 12 (with the container 14 stowed inside) by the shoulder strap 38. The thinness of the carrying case makes it possible for the user to place the carrying case under his arm, leaving both hands free for carrying other articles. It is also possible to provide the carrying case with other straps so that the carrying case can be carried as a knapsack on the user's back. When so carried the major dimension of the carrying case is sufficiently small that the carrying case does not protrude laterally beyond the user's sides. This permits the carrying case to be worn by a bicyclist or a motor cyclist without interferring with the air flow. The carrying case incorporates a flap 30 through which the tube 16 protrudes. When the carrying case is being carried, the tube 16 is retained by a strap 36 and the nozzle placed within the carrying case and held in position by the closure flap 32, which can be secured by suitable fasteners 34. Whether carried under the arm or on the back, the tube 16 is of sufficient length so that drinks can be dispensed, to the full reach of the users arm, without changing the position of the container.

When the user arrives at a stadium or similar location, the case and container can be stowed on the user's seat. Not only does the sizing of the case and container make possible this out of the way stowage, but an extremely comfortable cushion is produced as well. The flotation provided by the beverage may be supplemented, as liquid is withdrawn by the user blowing into the nozzle to reinflate the container.

Having described my invention, I now claim:

1. A liquid dispenser comprising:

a container for ingestible liquid comprising an envelope of flexible, collapsible, water impervious sheet material, a sealed second container wholly housed within said liquid container, said second container having a non-toxic temperature retaining material therein to provide direct surface contact and heat transfer between the liquid and said second container, said liquid container being collapsible closely around said second container for convenience in storage, transporting, freezing and heating, means for admitting liquid into the interior of said liquid container, dispensing means for controllable dispensing of the liquid from said liquid container, a carrying pouch for said liquid container generally conforming to the shape of said container when full of liquid, said pouch comprising means for protecting said liquid container and for providing thermal insulation for the liquid in said container, said pouch incorporating a tough fabric outer layer.

2. The liquid dispenser according to claim 1, wherein:

said container and said pouch have substantially planar principal surfaces and wherein the thickness of said pouch and container is less than one-quarter of either of the principal dimensions of said surfaces, the smaller of said principal dimensions being no greater than 18 inches.

3. The dispenser of claim 1, wherein:

said dispensing means comprises means for the controlled dispensing of liquid in said container at a point remote from said container and including a tube connected to the interior of said container at a first end thereof and having a openable valve at a second end thereof.

4. The dispenser according to claim 3, wherein:

said tube is of a sufficient length so that when said container is carried about the shoulder of a user, the valve may be extended to substantially the full reach of the user without disturbing the position of said container.

5. A liquid carrier and dispenser comprising:

a container for ingestible liquid comprising an envelope of flexible, collapsible, water impervious sheet material;

means for admitting ingestible liquid into the interior of said liquid container;

a sealed second container wholly housed within said liquid container, said second container having a non-toxic temperature retaining material therein to provide direct surface contact and heat transfer between the liquid and said second container, said liquid container being collapsible closely around said second container for convenience in storage, transporting, freezing and heating; and dispensing means for controlled dispensing of the liquid at a point remote from the liquid container.

6. The dispenser recited in claim 5 wherein said sheet material is a flexible poly-vinyl chloride of high strength which is freezable and heatable.

7. The dispenser recited in claim 5 and further comprising at least one internal web interconnecting opposite sides of said liquid container to maintain the shape of said liquid container whether it is selectively empty, full and partially full.

8. The dispenser recited in claim 5 and further comprising a carrying pouch for said liquid container, said carrying pouch completely surrounding said container and being thermally insulative as well as physically protective of said container.

9. The dispenser recited in claim 8 wherein said carrying pouch has at least one carrying strap.

10. The dispenser recited in claim 5 wherein said dispensing means comprises a tube connected to the interior of said liquid container and extending substantially beyond said container, said tube having a valve located at the distal end of said tube for controlling the discharge of the liquid.

11. A dispenser according to claim 10, wherein:

said liquid tube is connected to the interior of said container at an end of said container substantially opposite to said means for admitting liquid.

12. The dispenser recited in claim 5 wherein said non-toxic temperature retaining material is a freezable liquid.

13. A dispenser according to claim 5, wherein:

said means for admitting liquid into the interior of said liquid container comprises a filler neck which is extendible from a position substantially flush with the surface of said container to a filling position substantially beyond the surface of said container.

14. A dispenser according to claim 5, wherein:

said container comprises substantially planar upper and lower surfaces.

15. A dispenser according to claim 14, wherein said surfaces are substantially rectangular.

16. A dispenser according to claim 14, wherein the thickness of the container is less than one-quarter of either of the principal dimensions of said planar surfaces.

17. The dispenser according to claim 5, further including:

a second means for admitting liquid into the interior of said liquid container, a secondary pouch within said container for receiving all of the liquid from said second means for admitting liquid and for separating the liquid in said secondary pouch from the liquid in said container.

* * * * *

UNITED STATES PATENT AND TRADEMARK OFFICE

CERTIFICATE OF CORRECTION

PATENT NO. : 4,420,097

DATED : December 13, 1983

INVENTOR(S) : GREGG A. MOTSENBOCKER

It is certified that error appears in the above-identified patent and that said Letters Patent are hereby corrected as shown below:

Column 6, line 4, after the word "said", delete "liquid", line 5, before the word "container" (first instance), insert --liquid--.

Column 6, line 18, after the word "said", insert --liquid--.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*